US007853186B2

(12) United States Patent
Akashi et al.

(10) Patent No.: US 7,853,186 B2
(45) Date of Patent: Dec. 14, 2010

(54) DEVELOPING APPARATUS FEATURING MULTIPLE MAGNETIC ROLLERS

(75) Inventors: Kazukiyo Akashi, Kashiwa (JP); Tomoyuki Sakamaki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/620,852

(22) Filed: Nov. 18, 2009

(65) Prior Publication Data

US 2010/0061773 A1 Mar. 11, 2010

Related U.S. Application Data

(62) Division of application No. 11/499,731, filed on Aug. 7, 2006, now Pat. No. 7,653,336.

(30) Foreign Application Priority Data

Sep. 7, 2005 (JP) ..... 2005-259967

(51) Int. Cl.
*G03G 15/09* (2006.01)

(52) U.S. Cl. ..... 399/277; 399/119; 399/267; 399/276

(58) Field of Classification Search ..... 399/267, 399/269, 275, 276, 282, 229, 119, 120, 277
See application file for complete search history.

(56) References Cited

U.S. PATENT DOCUMENTS

| | | | |
|---|---|---|---|
| 4,637,973 | A | 1/1987 | Shigeta et al. |
| 6,973,281 | B2 | 12/2005 | Hirobe et al. |
| 7,099,609 | B2 | 8/2006 | Hirobe et al. |
| 7,236,727 | B2 | 6/2007 | Fukuda |
| 2003/0235437 | A1 | 12/2003 | Sakamaki |
| 2005/0036806 | A1 | 2/2005 | Hollig et al. |
| 2007/0053725 | A1 | 3/2007 | Sakamaki et al. |

FOREIGN PATENT DOCUMENTS

| | | | |
|---|---|---|---|
| CN | 1453660 | A | 11/2003 |
| JP | 10-171252 | A | 6/1998 |
| JP | 2003-323043 | A | 11/2003 |
| JP | 2003-323052 | A | 11/2003 |

*Primary Examiner*—David M Gray
*Assistant Examiner*—G. M. Hyder
(74) *Attorney, Agent, or Firm*—Fitzpatrick, Cella, Harper & Scinto

(57) ABSTRACT

A developing apparatus in which a first magnet of a first developing sleeve includes a first magnetic pole near a potion opposing to an image bearing member, and a second magnetic pole being downstream of the first magnetic pole; and a second magnet of a second developing sleeve includes a third magnetic pole near a portion opposing to the first sleeve. Assuming that a magnetic force obtained by combining normal direction forces Fr1 and Fr2 of magnetic forces generated by the first and second magnets, respectively, near the first sleeve is Fr, a center direction component of the first sleeve of the force Fr becomes positive between the first magnetic pole and a peak value position of the second magnetic pole, and a center direction component of the force Fr becomes negative between the peak value position and the closest position between both sleeves.

5 Claims, 8 Drawing Sheets

DEVELOPING APPARATUS FEATURING MULTIPLE MAGNETIC ROLLERS

This application is a divisional of U.S. patent application Ser. No. 11/499,731 filed Aug. 7, 2006.

BACKGROUND OF THE INVENTION

1. Field of the Invention

The present invention relates to a developing apparatus for developing an electrostatic image that has been formed through an electrophotographic printing method or an electrostatic recording method on an image bearing member.

2. Description of the Related Art

Up to now, in an image forming apparatus such as a copying machine which adopts an electrophotographic printing method, an electrostatic image formed on an image bearing member such as a photosensitive drum is visualized by adhering a developer onto the electrostatic image. For the developer, a magnetic one-component developer containing magnetic toner, a non-magnetic one-component developer containing non-magnetic toner, two-component developer containing non-magnetic toner and a magnetic carrier, and the like may be appropriately used.

As an example of conventional developing apparatuses using such the developers, a developing apparatus using the two-component developer containing non-magnetic toner and a magnetic carrier is illustrated in FIG. 7.

As shown in FIG. 7, a developing apparatus 1A using the two-component developer often has a structure of a single-sleeve developing apparatus. In other words, the developing apparatus 1A includes a developer carrying member for carrying and feeding the developer to develop an electrostatic image formed on a photosensitive drum. A developer carrying member 8 includes a developing sleeve 8*a* and a magnet roll 8*b* which is arranged so as to be fixed within the developing sleeve 8*a*. Further, the developing apparatus 1A stores the two-component developer in a developer container 2 and includes feeding screws 5 and 6 within the developer container 2 serving as feeding means for feeding the developer to the developing sleeve 8*a* while agitating the developer.

However, in the developing apparatus 1A, there is a possibility to be generated a blank area image which is one of image defects caused by an edge enhancement.

Hereinafter, the blank area image generating mechanism will be described with reference to FIG. 8. It should be noted that this is an example of a developing apparatus which adopts a reversal development method.

In general, in an electrostatic image formed on a photosensitive drum 10, when an image containing a halftone image is formed, the blank area image is generated in the vicinity of a border between a highlight image α which is formed at a downstream of a movement direction of a surface of the photosensitive drum 10, and a solid image β which is formed at an upstream thereof in a developing region. That is, the blank area image is generated between a trailing end of the highlight image α and a leading end of the solid image β.

FIG. 8 shows configurations of an equipotential surface and electrical lines H of force when a highlight portion α is provided on the photosensitive drum 10, a solid portion β is provided in a backward direction of the portion α, and a border portion γ between the highlight portion α and the solid portion β is opposed to the developing sleeve 8*a*. As apparent from FIG. 8, the electrical lines H of force is moved toward the solid portion β to a large extent in the vicinity of the border portion γ.

Thus, by using the developing method with a conventional structure in which the developing sleeve 8*a* is rotated in a forward direction with respect to the photosensitive drum 10, it is not possible to supply the trailing end of the highlight portion α with toner contained in the developer to be supplied. As a result, the development is performed along the electrical lines H of force toward the solid portion β. Therefore, it is presumed that a blank portion occurs at the trailing end of the highlight portion α.

Thus, in order to prevent the blank area image from occurring, a twin-sleeve developing method using the two-component developer has been proposed as shown in FIG. 9 (for example, see Japanese Patent Application Laid-Open No. H10-171252 and Japanese Patent Application Laid-Open No. 2003-323052).

A developing apparatus 1B adopting the twin-sleeve developing method includes two developer carrying members 8 and 9 at an upstream side and a downstream side of a rotating direction of the photosensitive drum 10, that is, the developing sleeves 8*a* and 9*a* including magnet rolls 8*b* and 9*b* within the developer container 2. Through a first developing process which is performed by using the developing sleeve 8*a* provided at the upstream side and a second developing process which is performed by using the developing sleeve 9*a* provided at the downstream side, the identical electrostatic latent images formed on the photosensitive drum 10 are visualized.

The twin-sleeve developing method is a developing method in which a potential difference between the highlight portion α and the solid portion β is reduced in the first developing process described above and the development is reliably performed at the trailing end of the highlight portion α in the second developing process, thereby preventing the blank area image from occurring.

However, there arises the following problem in the structure of the developing apparatus 1B adopting the twin-sleeve developing method.

Referring to FIG. 9, a description as to the problem in the twin-sleeve developing method will be given.

In the developing apparatus 1B, a delivery of a developer T is performed by a magnetic pole N3 of the magnetic roll 8*b* fixed within the developing sleeve 8*a* and by a magnetic pole S3 of the magnetic roll 9*b* fixed within the developing sleeve 9*a*. The developer once delivered onto the developing sleeve 9*a* is fed by the rotation thereof. However, it depends on each condition of the magnets within two sleeves that a part of the developer T is delivered again onto the developing sleeve 8*a*, so the developer T is likely to be retained in a portion between the developing sleeve 8*a* and the developing sleeve 9*b*. In a portion between the developing sleeve 8*a* and the developing sleeve 9*b*, the developer T is subsequently fed by the developing sleeve 8*a*. When the retained developer is excessively increased, there is a possibility that the retained developer is brought into contact with the photosensitive drum and disturbs the toner image formed on the photosensitive drum.

There is another possibility to cause a phenomenon that the developer T receives a large pressure due to the above-mentioned retention, fine particles such as titanium oxide externally added to the toner is embedded in the toner. Further, due to a friction between the toner and the magnetic carrier, a particle configuration of the toner itself may be rounded off. When the developing apparatus is used for a long period of time, a phenomenon that the toner is adhered to a surface of the magnetic carrier and is hard to be scraped off, so-called a spent phenomenon, may be caused. Thus, when a deterioration of the developer is caused, a triboelectrification amount (hereinafter, referred to as "triboelectricity") is changed according to a period of time in which the developing apparatus is used. Due to the change, an image density may be changed in association with a change of a developing performance of the toner, or a mechanical adhesion of the toner with respect to the magnetic carrier or the photosensitive drum is increased, whereby development or transferring corresponding to an electric field is less likely to be performed. As a result, a partial defect (i.e., unevenness) of the toner is caused, thereby forming an image making an extremely bad impression after the usage of the developing apparatus for a long period of time.

After a study by the inventors of the present invention, it becomes apparent that the above-mentioned problem is closely related to positions of the magnetic pole N3 of the magnet roll 8*b* and the magnetic pole S3 of the magneto roll 9*b*, and to a magnetic force generated by these magnetic poles.

For example, when an idling of the developing apparatus is performed for an hour by setting a magnetic force of the magnetic pole S3 as 1.5 times of the magnetic pole of N3, it becomes apparent that the developer is not retained in a portion between the developing sleeves. In addition, when a position of the magnetic pole S3 is moved by an angle of 5° to a downstream side of a rotating direction of the developing sleeve 9 without changing the magnetic force, the same result has been obtained.

The developing apparatus 1B has a structure in which an attraction of the developer in the developing sleeve 9*a* is enhanced in order to prevent the retention of the developer in a portion between the developing sleeves 8*a* and 9*a*. However, in the structure of the positions of the magnetic pole N3 and the magnetic pole S3, and the configuration of the magnetic force, there arises the following problem. That is, as shown in FIG. 10, the developer is delivered from the magnetic pole S2 to the magnetic pole N4 not through the magnetic pole N3 and the magnetic pole S3, thereby the developer is retained like a bridge. This is a problem of a so-called "bridge phenomenon of a developer".

When the bridge phenomenon of the developer is generated, the photosensitive drum 10 and the developer T are rubbed over a wide range. As a result, the toner image formed on the photosensitive drum 10 which is formed into the toner image by the developing sleeve 8*a* is scraped off, thereby causing so-called "scavenging phenomenon" to remarkably deteriorate an image level.

As described above, even when the magnetic field for promoting the delivery of the developer is formed to prevent the retention of the developer in a developer delivering part of two sleeves, in a case where the "bridge phenomenon of the developer" is caused in another place, a disturb of the toner image is finally caused.

After the study by the inventors of the present invention, the above-mentioned problem is caused by the following reason.

That is, a magnetic coupling between the magnetic pole N3 of the magnetic roll 8*b* and the magnetic pole S3 of the magnetic roll 9*b* is promoted, and to the contrary, a magnetic coupling between the magnetic pole S2 and the magnetic pole N3 is weakened. As a result, magnetic force lines are newly generated in each of the magnetic pole S2 and the magnetic pole N4.

In a case where the distance between the developing sleeves 8*a* and 9*a* is increased to thereby obtain a configuration in which magnetic force lines are not easily generated, the "bridge phenomenon of the developer" has not been generated when an idling of the developing apparatus is performed for an hour.

SUMMARY OF THE INVENTION

Therefore, an object of the present invention is to provide a developing apparatus capable of preventing an image defect due to a retention of a developer which is caused by delivering the developer carried by the first developer carrying member to the second developer carrying member.

To attain the above-mentioned object, the developing apparatus, includes: a developer container for containing a magnetic developer; a first developer carrying member rotatably provided to the developer container, for carrying the magnetic developer to feed it to a first developing portion; a second developer carrying member rotatably provided to the developer container in the same direction as the first developer carrying member, for carrying the magnetic developer delivered from the first developer carrying member to feed it to a second developing portion; a first magnetic field generating means arranged to be fixed in the first developer carrying member, the first magnetic field generating means including: a first magnetic pole arranged in the vicinity of a portion opposing to the image bearing member; and a second magnetic pole arranged to be adjacent to a downstream side of a movement direction of the first developer carrying member with respect to the first magnetic pole, in the vicinity of a portion opposing to the second developer carrying member, and at an upstream side with respect to a closest position between the first developer carrying member and the second developer carrying member, and having a polarity opposite to the first magnetic pole; and a second magnetic field generating means arranged to be fixed in the second developer carrying member, the second magnetic field generating means being arranged in the vicinity of a portion opposing to the first developing carrying member and having a third magnetic pole having a polarity opposite to the second magnetic pole, in which when it is assumed that a magnetic force, which is obtained by combining a force Fr1 acting in a normal line direction of a magnetic force generated by the first magnetic field generating means in the vicinity of the first developer carrying member, and a force Fr2 acting in a normal line direction of a magnetic force generated by the second magnetic field generating means in the vicinity of the first developer carrying member, is set as a magnetic force Fr, and a direction toward a center of the first developer carrying member is positive, a component obtained in the direction of the center of the first developer carrying member of the force Fr is positive at least between the first magnetic pole and a position where a strength of the magnetic field of the second magnetic pole becomes a peak value, and a component obtained in the direction of the center of the first developer carrying member of the force Fr is negative between a position where a strength of the magnetic field of the second magnetic pole becomes a peak value and the closest position.

Further features of the present invention will become apparent from the following description of exemplary embodiments (with reference to the attached drawings).

DESCRIPTION OF THE EMBODIMENTS

Hereinafter, a description will be given in more detail of a developing apparatus and an image forming apparatus according to the present invention with reference to the accompanying drawings.

First Embodiment

Figure 1:
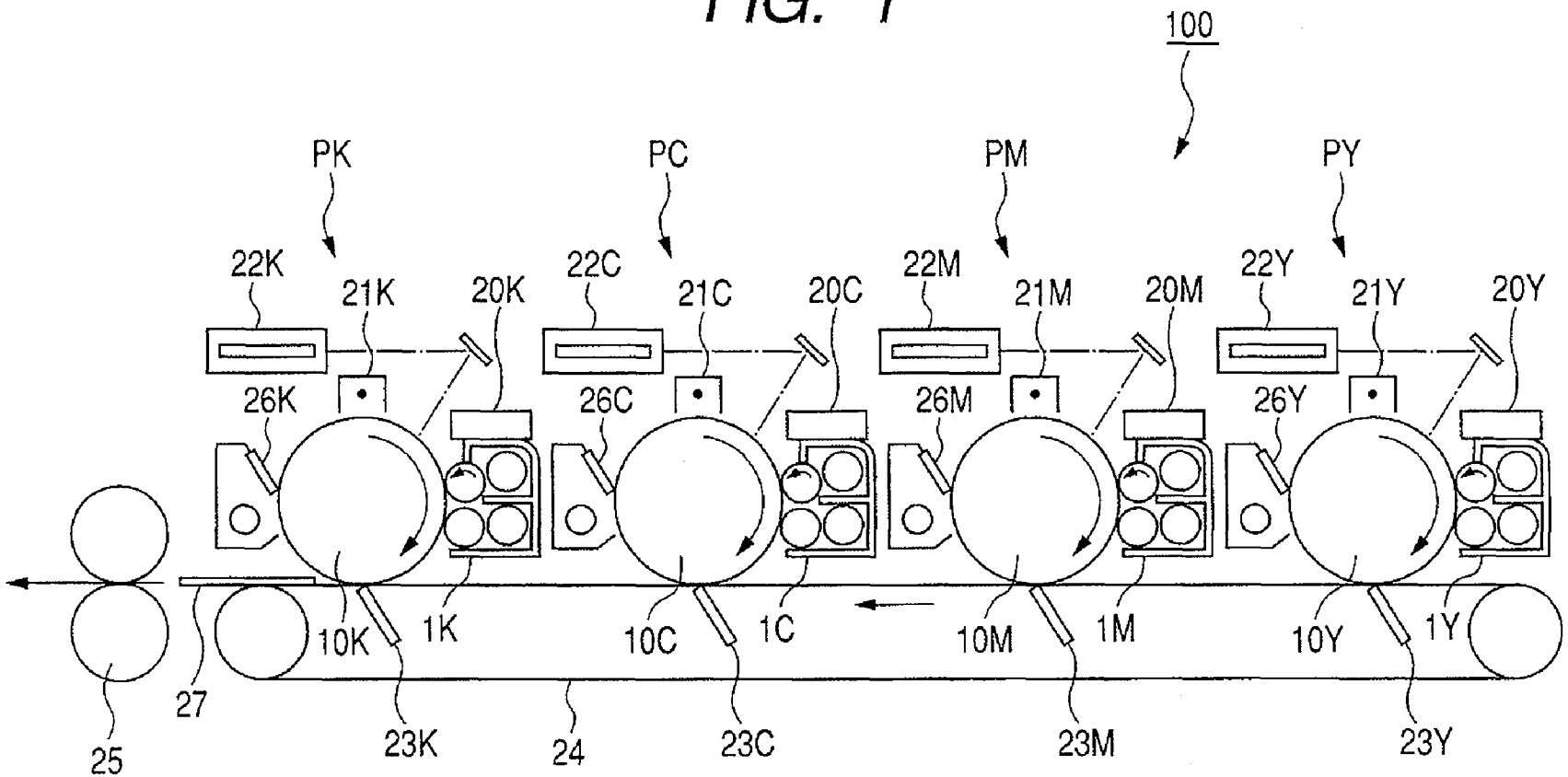
FIG. 1 is a schematic diagram showing an embodiment of an image forming apparatus according the present invention.

First, with reference to FIG. 1, a description will be given of a schematic structure of an image forming apparatus according to an embodiment of the present invention, and thereafter a description will be given of a developing apparatus that constitutes a characteristic portion of the present invention. In this embodiment, the image forming apparatus 100 is directed to a multicolor image forming apparatus of a tandem type using an electrophotographic printing method. However, the present invention is not limited to the above-mentioned structure.

A multicolor image forming apparatus according to this embodiment includes image forming portions for Yellow (Y), Magenta (M), Cyan (C), and Black (B) which are arranged in a line, that is, an image forming stations P (PY, PM. PC, and PK), and a conveyor belt 24 serving as a transfer material carrying member for bearing and carrying a transfer material S.

Each image forming stations P (PY, PM. PC, and PK) has substantially the same structure, images for Yellow (Y), Magenta (M), Cyan (C), and Black (K) are formed as a full-color image.

The conveyor belt 24 attracts a transfer paper 27 serving as a recording material to deliver the transfer paper 27 to the image forming stations P (PY, PM, PC, and PK). A developer image formed on the image forming stations P (PY, PM, PC, and PK), in other words, a toner image, is transferred onto the transfer paper 27, thereby forming a full-color image on the transfer paper 27.

The image forming stations P (PY, PM, PC, and PK) will be further described.

The image forming stations P (PY, PM, PC, and PK) each includes an electrophotographic photosensitive member having a shape of a rotating drum which is repeatedly used as an image bearing member, that is, photosensitive drums 10 (10Y, 10M, 10C, and 10K). The photosensitive drums 10 (10Y, 10M, 10C, and 10K) are driven to be rotated at a predetermined circumferential speed (i.e., process speed) in a clockwise direction indicated by the arrow.

On the periphery of the photosensitive drums 10 (10Y, 10M, 10C, and 10K), primary chargers 21 (21Y, 21M, 21C, and 21K) and image exposure devices 22 (22Y, 22M, 22C, and 22K) are arranged. Each surface of the photosensitive drums 10 (10Y, 10M, 10C, and 10K) is uniformly subjected to a charging process by the primary chargers 21 (21Y, 21M, 21C, and 21K), and then is subjected to an exposure by the image exposure devices 22 (22Y, 22M, 22C, and 22K) to form an electrostatic latent image.

Further, on the periphery of the photosensitive drums 10 (10Y, 10M, 10C, and 10K), developing apparatuses 1 (1Y, 1M, 1C, and 1K) for developing the electrostatic latent image formed on the photosensitive drums 10 (10Y, 10M, 10C, and 10K) are arranged. In addition, on the periphery of the photosensitive drums 10 (10Y, 10M, 10C, and 10K), cleaning devices 26 (26Y, 26M, 26C, and 26K) for removing toner on the photosensitive drum 10 are arranged.

Further, inside the conveyor belt 24, transfer chargers serving as transfer devices which correspond to transfer blades 23 (23Y, 23M, 23C, and 23K) in this embodiment are arranged at positions opposing to the photosensitive drums 10 (10Y, 10M, 10C, and 10K).

The developing apparatus 1, for example, collectively denotes the developing apparatus 1Y, the developing apparatus 1M, the developing apparatus 1C, and the developing apparatus 1K in the image forming stations P (PY, PM, PC, and PK) commonly in the following descriptions. The same is true in other devices and members.

Hereinafter, an operation of the whole image forming apparatus with the above-mentioned structure will be described with reference to FIG. 1.

The photosensitive drum 10 serving as an image bearing member is rotatably provided, charges the photosensitive drum 10 uniformly with the primary charger 21, and exposes with modulated light in response to an image information signal by the image exposure device 22 which is provided with a light emitting device such as a laser to form an electrostatic latent image.

The electrostatic latent image is visualized as a developer image (i.e., toner image) by the developing apparatus 1 through a developing process to be described below. The toner image formed on the photosensitive drum 10 is subsequently transferred onto the delivered transfer paper 27, from the photosensitive drum 10 of each of the image forming stations P by the transfer blade 23 to form a full-color toner image on the transfer paper 27. Then, the full-color toner image formed on the transfer paper 27 is fixed on the transfer paper 27 by a fixing device 25 to obtain a permanent image. Further, residual toner on the photosensitive drum 10 is removed by the cleaning device 26.

On the other hand, the toner which is contained in the developer in the developing apparatus 1 and is consumed in the developing process is sequentially replenished from toner replenishment containers 20 (20Y, 20M, 20C, and 20K) to optimize toner density within the developing apparatuses 1 (1Y, 1M, 1C, and 1K).

In this embodiment, adopted is a method in which the toner image is directly transferred onto the transfer paper 27 serving as the recording material on the conveyor belt 24 from the photosensitive drums 10M, 10C, 10Y, and 10K. However, an image forming apparatus provided with, for example, an intermediate transfer member having a shape of a belt, in lieu of the conveyor belt 24, may also be applied to the present invention. In other words, in the image forming apparatus with this structure, the toner images for each color are subsequently primarily transferred onto the intermediate transfer member from the photosensitive drums 10M, 10C, 10Y, and 10K provided for each color, and then composite toner images for each color are collectively secondarily transferred onto the transfer paper.

Next, the developing apparatus with the features of the present invention will be described.

As a developing apparatus adaptable to the present invention, there is a developing apparatus in which an electrostatic image formed on an image bearing member is developed with a non-magnetic developer by using a first developer carrying member and a second developer carrying member each including a magnetic filed generating means, in other words, the developing process is performed twice for one electrostatic image. In particular, the developing apparatus uses the developer containing non-magnetic toner and a magnetic carrier, which may be applied to the developing apparatus which performs development by bringing a magnetic brush, which is magnetically formed on each of the first developer carrying member and the second developer carrying member, into contact with the electrostatic image formed on the image bearing member in each of the developing apparatuses. In the developing apparatus having such the structure, the magnetic carrier has a feature of performing a triboelectric charge with respect to the non-magnetic toner. The "triboelectric charge" is performed by agitating and feeding the toner when the developer is circulated within a developer container.

Next, an embodiment of the developing apparatus 1 will be described with reference to FIG. 2.

The developing apparatus 1 according to this embodiment includes a developer container 2 which contains the magnetic developer containing the non-magnetic toner and the magnetic carrier. In the developing apparatus 1, a first developer carrying member 8 and a second developer carrying member 9 are provided to be opposed to each other at an opening portion which faces the photosensitive drum 10 of the developer container 2.

In this embodiment, the first developer carrying member 8 is composed of a non-magnetic cylindrical rotary member, that is, a developing sleeve 8*a*, and a magnet roll 8*b* serving as a magnetic field generating means fixed non-rotatably within the developing sleeve 8*a*. The second developer carrying member 9 is composed of the non-magnetic cylindrical rotary member, that is, a developing sleeve 9*a*, and a magnet roll 9*b* serving as a magnetic field generating means fixed non-rotatably within the developing sleeve 9*a*. In this embodiment, the developing sleeves 8*a* and 9*a* are arranged in a vertical direction and are pivotally supported so as to be freely rotated. Rotating directions of the developing sleeves 8*a* and 9*a* are set to be the same direction (e.g., a counterclockwise direction in FIG. 2) so as to be opposite directions in an area in which the developing sleeves 8*a* and 9*a* are opposed to each other. A rotational speed (i.e., circumferential speed) of the developing sleeves 8*a* and 9*a* are substantially the same.

Further, in the developer container 2, there is provided a regulating blade 11 serving as a developer regulating member for regulating a thickness of the developer carried on a surface of the developing sleeve 8*a*.

In the developer container 2, a developing chamber 3 and an agitating chamber 4 which are partitioned by a partition wall 7 are provided in a vertical direction at an opposite side of the opening portion. In the developing chamber 3 and the agitating chamber 4 which constitute a circulating path of the developer, a first feeding screw 5 and a second feeding screw 6 which serve as agitating and feeding means for the developer are provided, respectively.

The first feeding screw 5 carries the developer within the developing chamber 3. The second feeding screw 6 carries the toner, which is supplied to an upstream side of the first feeding screw 5 within the agitating chamber 4 from a toner replenishing port (not shown), and the developer, which is previously provided in the agitating chamber 4, while agitating the toner and the developer.

Figure 3:
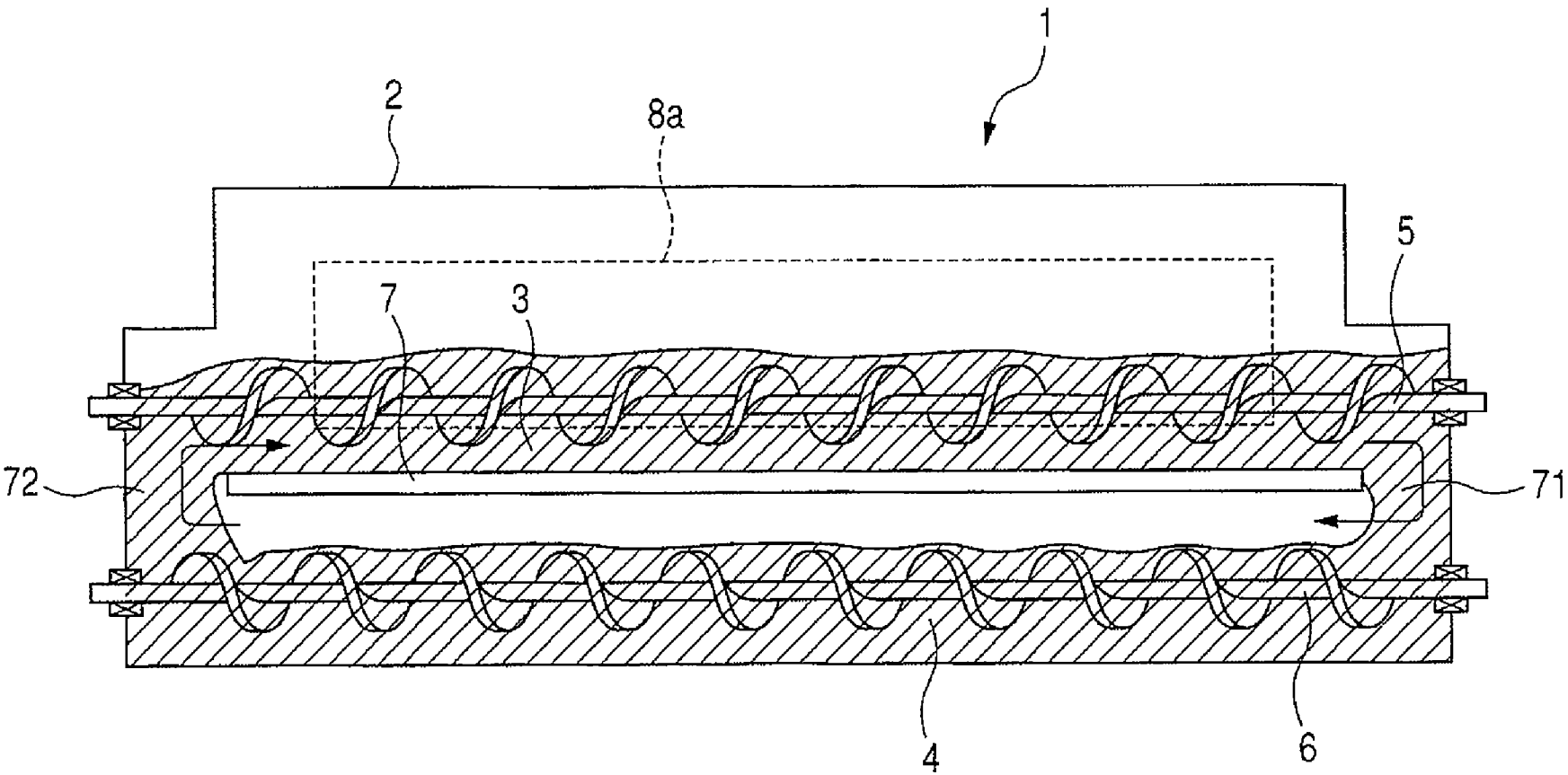
FIG. 3 is a cross-sectional view for explaining circulation of a developer in a developing apparatus.

As can be understood by also referring to FIG. 3, the partition wall 7 is provided with an opening 71 in the vicinity of one end of an axial direction of the first and second feeding screws 5 and 6, and through the opening 71, the developer is supplied from the developing chamber 3 to the agitating chamber 4 by gravitation.

On the other hand, the partition wall 7 is also provided with an opening 72 in the vicinity of the other end of the axial direction of the first and second feeding screws 5 and 6. Through the opening 72, the developer supplied from the agitating chamber 4 to the developing chamber 3 against the gravity is drawn to the developing sleeve 8*a* by a magnetic pole N1 of the magnet roll 8*b* serving as the first magnetic field generating means which is non-rotatably provided in the developing sleeve 8*a*. The developer drawn to the developing sleeve 8*a* is carried from a magnetic pole S1 to a magnetic pole N2 on the developing sleeve 8*a* as a result of the rotation of the developing sleeve 8*a*, and then reaches a first developing portion 12 at which the developing sleeve 8*a* and the photosensitive drum 10 are opposed to each other and a developing magnetic pole S2 is provided. While the developer is carried, the thickness of the developer is magnetically regulated by the regulating blade 11 in cooperation with the magnetic pole S1 which is located at a position where the magnetic pole S1 is substantially opposed to the regulating blade 11, thereby making it possible to reduce the thickness of the developer. In the first developing portion 12, a first developing process for the electrostatic image formed on the photosensitive drum 10 is performed.

After the process, the developer is delivered from a magnetic pole N3, which is provided at a downstream of the first developing portion 12 in the rotating direction of the developing sleeve 8*a*, to a magnetic pole S3 of the magnet roll 9*b* serving as the second magnetic field generating means non-rotatably provided in the developing sleeve 9*a*. As a result, the developer reaches a second developing portion 13 of a developing magnetic pole N4 at which the developing sleeve 9*a* and the photosensitive drum are again opposed to each other, and is used for a second developing process with respect to the electrostatic image formed on the photosensitive drum 10. In other words, the developing sleeves 8*a* and 9*a* develop the common electrostatic image on the photosensitive drum 10.

Then, the developer which is not used for the development and remained in the second developing portion 13 is carried into the developer container 2 by a magnetic pole S4 which is provided at the downstream of the second developing portion 13 in the rotating direction of the developing sleeve 9*a*. The developer on the developing sleeve 9*a* is removed from the developing sleeve 9*a* by repulsive magnetic fields of the magnetic poles S3 and S4 of the magnetic roll 9*b*, and is collected into the agitating chamber 4 forming a lower part within the developer container 2.

As shown in FIG. 3, the collected developer is agitated and fed to the other end of the agitating chamber 4 by the feeding screw 6 so as to be sufficiently mixed with the replenish toner, and is delivered to the developing chamber 3 through the communicating path 72. The developer carried through the communicating path 72 is fed to the developing sleeve 8*a* while being agitated and fed by the feeding screw 5.

The developing apparatus 1 according to the present invention, as in the case of this embodiment, includes at least a plurality of developer carrying members 8 and 9 which are opposed to the image bearing member (i.e., the photosensitive drum 10). Each of the developer carrying members 8 and 9 includes rotatably-provided non-magnetic cylindrical members (i.e., developing sleeves 8 and 9) and magnetic field generating means (i.e., magnetic rolls 8*b* and 9*b*) which are provided so as to be fixed within the non-magnetic cylindrical member.

It is preferable that the non-magnetic cylindrical members serving as the developing sleeves 8*a* and 9*a* be formed of a electrically-conductive material. For the electrically-conductive material, metals such as stainless and aluminum, a resin body having electrical conductivity by dispersion of conductive particles, and a variety of materials conventionally known, may be used. The non-magnetic cylindrical member may be subjected to a process in which the surface thereof is made rough by blasting or the like so as to enhance the carrying performance of the developer. In this embodiment, the surfaces of the developing sleeves 8*a* and 9*a* are subjected to the substantially the same surface-roughening process, so each surface roughness of the developing sleeves 8*a* and 9*a* is substantially the same.

In the magnetic rolls 8*b* and 9*b* serving as the magnetic field generating means, a plurality of magnetic poles are fixed in the non-magnetic cylindrical member so that the magnetic poles are relatively static with respect to the non-magnetic cylindrical member. For the magnetic field generating means, means such as a magnet which permanently generates a magnetic field, and a magnet which arbitrarily generates a constant magnetic filed or a magnetic field having different polarities may be used.

In the developing apparatus 1 shown in FIG. 2 according to this embodiment, the non-magnetic toner and the two-component developer containing low-magnetization high-resistance carrier, which are described below, are used.

The non-magnetic toner is formed by appropriately using a binder resin such as a styrene resin and a polyester resin, a colorant such as carbon black, dye, and a pigment, a release agent such as wax, a charge control agent, and the like. The non-magnetic toner may be manufactured by a normal method such as a grinding method and a polymerization method.

It should be noted that the triboelectrification amount of the non-magnetic toner, which has a negative charging characteristic, is preferably about in a range of $-1\times10^{-2}$ to $-5.0\times10^{-2}$ C/kg. When the triboelectrification amount of the non-magnetic toner is not within the above-mentioned range, the development efficiency is reduced, and the amount of counter charges generating in the magnetic-carrier is increased, thereby deteriorating the level of the blank portion. As a result, an image defect may be caused. The triboelectrification amount of the non-magnetic toner may be regulated in accordance with types of the materials to be used, and may be regulated by adding an extraneous additive described below.

It is possible to measure the triboelectrification amount of the non-magnetic toner by using a normal blow-off method, sucking the toner from the developer by air-suction with the developer amount of about 0.5 to 1.5 g, and by measuring the amount of charges induced in a measuring container.

For the magnetic carrier, carriers conventionally known may be used. For example, it is possible to use a resin carrier which is formed by dispersing a magnetite serving as a magnetic material and dispersing carbon black for electrical conduction and resistance regulation in a resin. Further, a resin carrier which is formed by oxidizing a surface of a magnetite simple substance such as ferrite and by performing a reduction treatment to regulate the resistance, or a resin carrier which is formed by being coated with a surface resin of a magnetite simple substance such as the ferrite to regulate the resistance may also be used. The method of manufacturing the magnetic carrier is not particularly limited.

It should be noted that the magnetic carrier preferably has the magnetization in a range of $3.0\times10^4$ A/m to $2.0\times10^5$ A/m in the magnetic filed of 0.1 tesla. When the magnetization amount of the magnetic carrier is reduced, scavenging due to the magnetic brush is effectively suppressed. However, it becomes difficult to adhere the magnetic carrier to the non-magnetic cylinder by the magnetic field generating means, so there is a possibility that an image defect due to the adhesion of the magnetic carrier or the like to the photosensitive drum is caused, or that a swept image described above is generated. Further, when the magnetization of the magnetic carrier is beyond the above-mentioned range, the image defect may be caused by the pressure of the magnetic brush as described above.

Further, a volume resistivity of the magnetic carrier is preferably in a range of $10^7$ to $10^{14}$ Ω·cm in view of the leak or developing performance.

The magnetization of the carrier is measured using an oscillating-field-type magnetic characteristics automatic recorder BHV-30 manufactured by Riken Denshi. Co., Ltd. A magnetic characteristic value of carrier powder is obtained by generating an external magnetic field of 0.1 T to measure the strength of the magnetic field at the time.

The carrier is packed densely enough in a cylindrical plastic container. In this state, a magnetic moment and an actual weight obtained when a sample is provided are measured, thereby obtaining the strength of the magnetization (in the unit of $Am^2/kg$). Subsequently, a true specific gravity of the carrier particle is obtained by using a Micromeritics Gas Pycnometer Accupyc 1330 (manufactured by Shimadzu Corporation), and the strength of the magnetization (in the unit of $Am^2/kg$) is multiplied by the true specific gravity, thereby making it possible to obtain the strength of the magnetization (i.e., A/m) per unit volume used in the present invention.

The developing apparatus according to this embodiment has a structure in which two developer carrying members are included and two developing parts are provided. In this embodiment, the developing apparatus with this structure is provided to take measures to prevent the blank portion from occurring by improving the development efficiency thereof, and further is provided to obtain high-quality image by using the two-component developer containing the low-magnetization high-resistance carrier. Herein, in this embodiment, a peak strength and a position of the magnetic force, which acts on the developer carried on each of the developing sleeves 8*a* and 9*a* by each of the magnetic field generating means, are regulated. As a result, the delivery of the developer from the developing sleeve 8*a* to the developing sleeve 9*a* is performed smoothly, thereby preventing the toner image from being disturbed.

Figure 2:
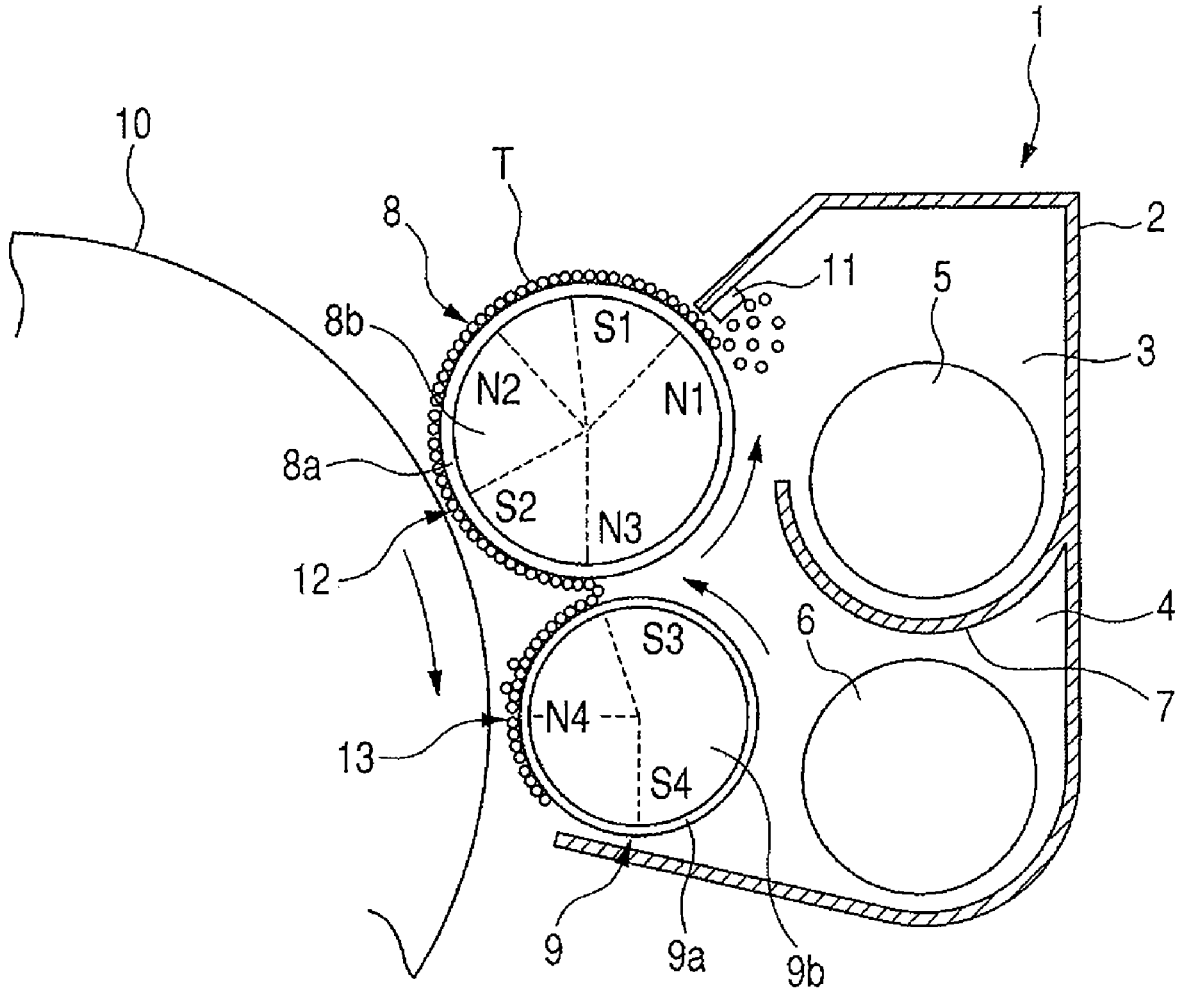
FIG. 2 is a cross-sectional view showing an embodiment of an developing apparatus according to the present invention.

To be specific, the developing apparatus shown in FIG. 2 is provided to reduce the problem of sweeping or scavenging phenomenon caused by the magnetic brush provided on the second developing sleeve 9*a* in the second developing process, thereby preventing the image defect such as the blank portion.

The image forming apparatus is not particularly limited as long as the image forming apparatus adopts the method of developing the electrostatic latent image formed on the image bearing member to record the image on a sheet or the like. A conventionally-known image forming method such as the electrophotographic printing method or the electrostatic recording method may be adopted.

Next, with reference to FIGS. 4A, 4B, and 4C, parts which characterize the developing apparatus 1 according to this embodiment will be described. To be specific, the magnetic fields generated by the first and second magnetic field generating means (i.e., magnetic rolls 8*b* and 9*b*) in the first and second developing sleeves 8*a* and 9*a* of the first and second developer carrying member 8 and 9 will be described.

Figure 4A:
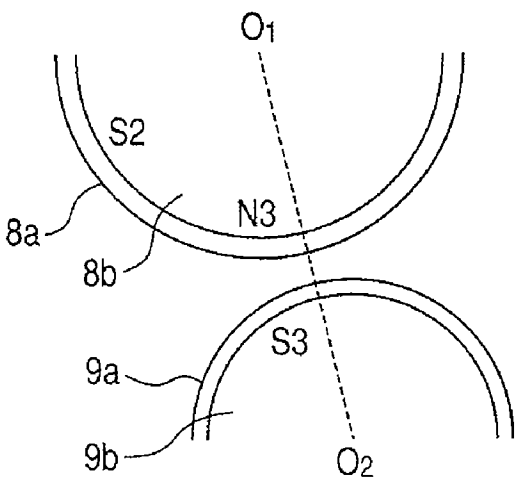
FIGS. 4A, 4B, and 4C are partial cross-sectional views of a developer carrying member of a developing apparatus for explaining a bridge phenomenon of a developer.

FIG. 4A schematically shows a structure of an area in which the first developer carrying member 8 and the second developer carrying member 9 are opposed to each other, in other words, in this embodiment, the vicinity of an area in which the magnetic pole N3 of the magnetic roll 8*b* serving as a delivering pole and the magnetic pole S3 of the magnetic roll 9*b* are opposed to each other.

Figure 4B:
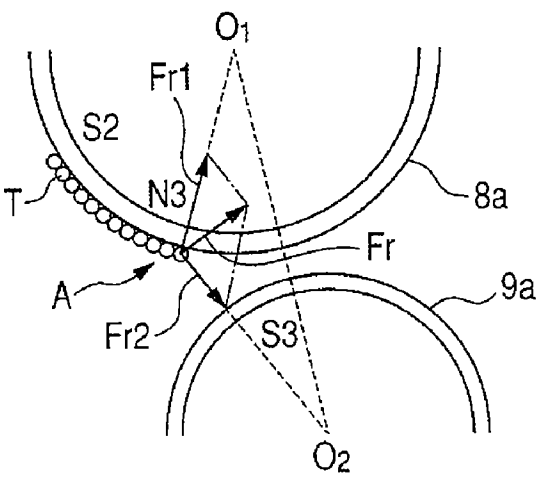

FIG. 4B shows the magnetic force F (i.e., vector) generated by the magnet rolls 8*b* and 9*b* provided in an arbitrary position on the surface of the developing sleeve 8*a*, which is the non-magnetic cylinder. In this embodiment, a component of the magnetic force F which is obtained in a direction (i.e., normal line direction) of a center (indicated by reference symbol $O_1$) of the developing sleeve 8*a* is set as the magnetic force Fr1 generated by the magnetic roll 8*b*. In addition, a component of the magnetic force F which is obtained in a direction (i.e., normal line direction) of a center (indicated by reference symbol $O_2$) of the developing sleeve 9*a* is set as the magnetic force Fr2 generated by the magnetic roll 9*b*. Each of the magnetic forces Fr1 and Fr2 represents a force (i.e., magnetic attraction force) of attracting the magnetic carrier (i.e., magnetic brush) which carries the toner on the developing sleeve 8*a* by the magnet rolls 8*b* and 9*b*.

Hereinafter, a calculation method of the magnetic force F will be described.

With respect to one magnetic carrier, the magnetic force Fr (i.e., Fr1 and Fr2) (in units of Newton (N)) which act perpendicularly to a peripheral surface of the developing sleeve 8*a* is defined by the following formula. When it is assumed that the magnetization of the magnetic carrier is m (i.e., vector, the unit of |m| is A/m), the volume of one magnetic carrier is V [$m^3$], the strength of the magnetic field generated by the magnet rolls 8*b* and 9*b* is B (B=(Br, Bθ)), and the direction toward a rotation center of the developing sleeves 8*a* and 9*a* is a positive (i.e., plus) direction, the magnetic force Fr is obtained by the following formula by setting a constant as A:

$$\begin{aligned} Fr &= -A\nabla r(m\cdot B) \\ &= -Ad/dr(|m|VB\cdot B) \\ &= -|m|VAd/dr(B^2) \\ &= -|m|VAd/dr\{(Br)^2+(B\theta)^2\}. \end{aligned}$$

In this case, since A represents the constant, |m| represents a function of a magnetic permeability, and r is set as a radiation direction (i.e., normal line direction) with respect to each surface of the developing sleeves 8*a* and 9*a*, the direction of the force corresponds to a direction of a force toward each center of the developing sleeves 8*a* and 9*a*.

In other words, the magnetic force Fr1 and the magnetic force Fr2 are represented by the following formula:

$$Fr1=A\cdot\nabla r\{(Br1)^2+(B\theta 1)^2\}$$

$$Fr2=A\cdot\nabla r\{(Br2)^2+(B\theta 2)^2\}.$$

Therefore, on the surface of the developing sleeve 8*a*, the magnetic force Fr1 and the magnetic force Fr2 which act on each center of the developing sleeves 8*a* and 9*a* are proportional to an inclination (in this case, a direction toward the center of each developing sleeve is set in a positive (i.e., plus) direction) with respect to the direction perpendicular to each surface of the developing sleeves 8*a* and 9*a*, of the sum of the squared absolute value of Br and the squared absolute value of Bθ.

Figure 4C:
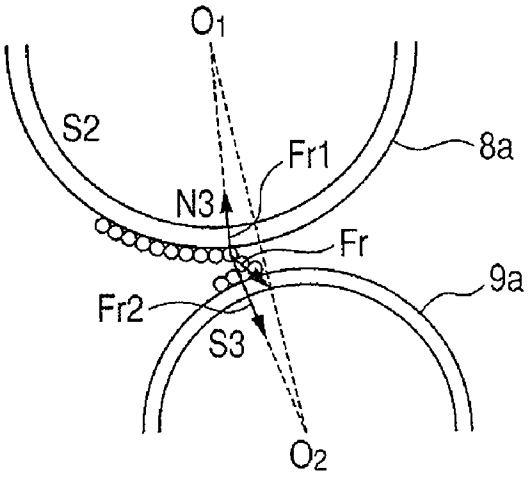

In this embodiment, assuming that the magnetic force Fr obtained by combining the magnetic force Fr1 and the magnetic force Fr2 is set in the positive (i.e., plus) direction toward the center of the developing sleeve 8*a*, an example of carrying of the developer is shown in FIGS. 4A to 4C.

In this embodiment, FIG. 4B shows a point at which the combined force Fr of the magnetic force Fr1 and the magnetic force Fr2 at a point A arbitrarily set on the surface of the developing sleeve 8*a* by the magnetic field generating means 8*b* and 9*b* is lower than the peak value of the magnetic field strength of the magnetic pole N3. At this point, the component obtained in the direction of the center of the developing sleeve 8 of the magnetic force Fr is positive. That is, the developing sleeve 8*a* is set so that the magnetic force toward the center of the developing sleeve 8*a* exists.

Further, FIG. 4C shows that the developer has passed through the position at which the peak value of the strength of the magnetic field of the magnetic pole N3 is obtained. In this state, the developer is delivered to the developing sleeve 9*a*. It means that the component obtained in the direction of the center of the developing sleeve 8*a* of the magnetic force Fr is reversed (i.e., becomes negative).

In other words, in this embodiment, the component obtained in the direction of the center of the developing sleeve 8*a* of the magnetic force Fr is set to be positive at least from the magnetic pole S2 to a position where the peak value of the magnetic field of the magnetic pole N3 is obtained. With such the structure, it is possible to prevent the developer from being retained at an upstream side with respect to the magnetic pole N3. Then, the component obtained in the direction of the center of the developing sleeve 8*a* of the magnetic force Fr is set to be negative from a position where the peak value of the magnetic field of the magnetic pole N3 is obtained to the closest position of two developing sleeves, thereby making it possible to smoothly deliver the developer to the developing sleeve 9*a*.

In a case where the component obtained in the direction of the center of the developing sleeve 8*a* of the magnetic force Fr is reversed to be negative at the position at the upstream side with respect to the position where the peak value of the magnetic field of the magnetic pole N3 is obtained, a carrying force of the developing sleeve 8*a* is reduced before the developer reaches the magnetic pole N3. The developer having difficulty in being carried does not reach the magnetic pole N3 smoothly, thereby causing the retention of the developer at the upstream side with respect to the magnetic pole N3.

With such the structure, the developer subjected to the first developing process by the developing sleeve 8*a* is reliably held and carried to the developing sleeve 8*a* without being attracted by the developing sleeve 9*a*.

When the image formation is performed by using the developing apparatus having the structure described above, a high-quality image can be obtained without causing the retention of the developer.

Second Embodiment

In the above-mentioned first embodiment, described is the developing apparatus in which the magnetic pole N3 serving as the delivering pole and the magnetic pole S3 of each of the developing sleeves 8*a* and 9*a* are substantially opposed to each other.

Figure 5B:
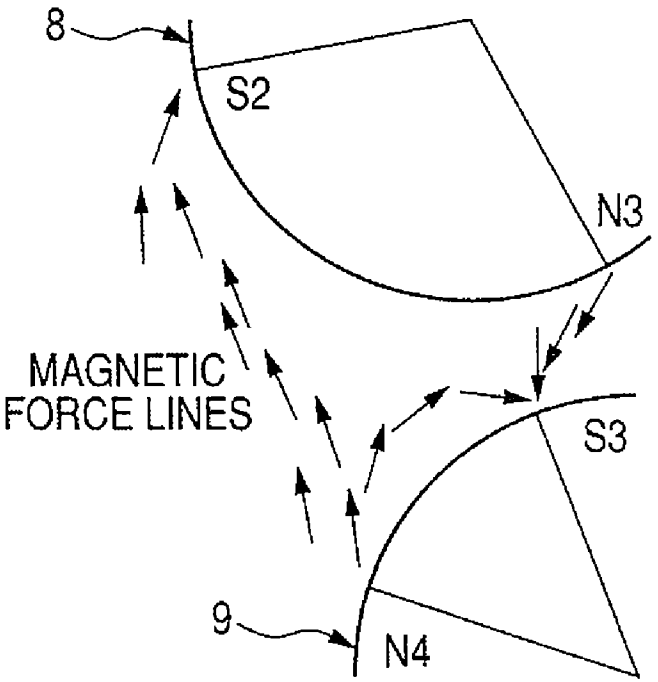
FIGS. 5A and 5B are cross-sectional views for explaining an example of carrying the developer in the developing apparatus.
Figure 5A:
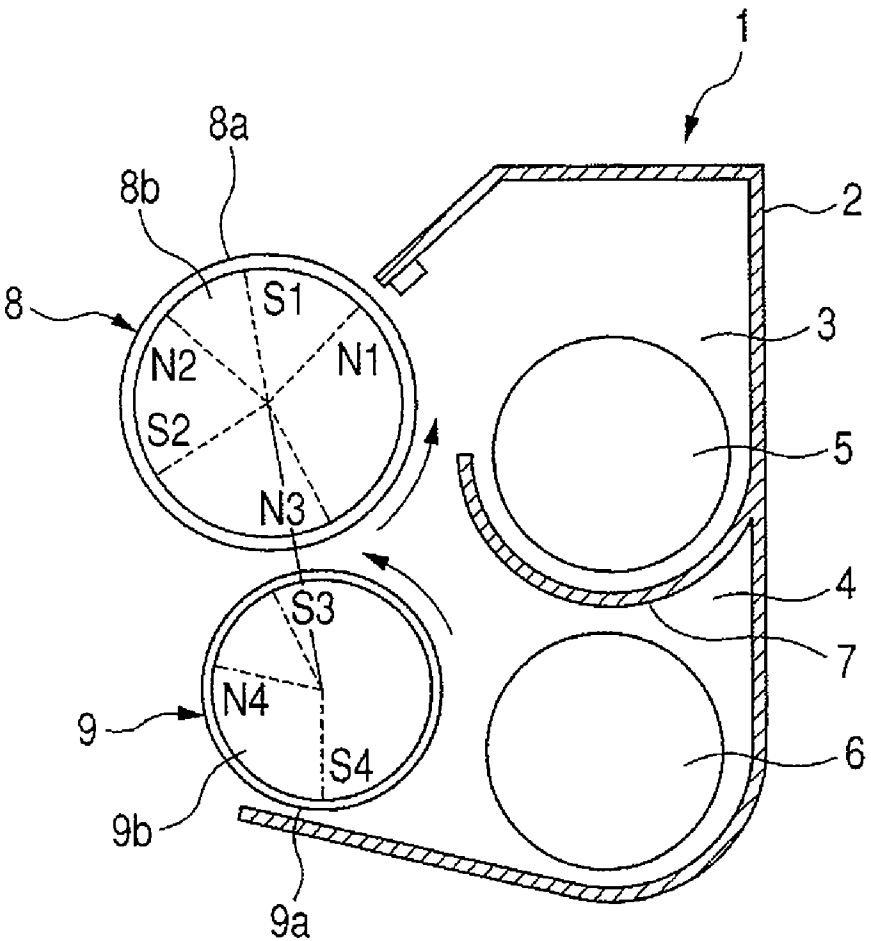

On the other hand, for example, as shown in FIG. 5A, when the magnetic pole S2 and the magnetic pole N3 are separated from each other in the developing sleeve 8*a*, the magnetic force Fr is weakened between the poles, so the developer is attracted by the developing sleeve 9*a*. Then, as shown in FIG. 5B, magnetic force lines between the magnetic pole S2 and the magnetic pole N3 are blocked off due to the strength and position of the magnetic field of the delivering pole S3 of the developing sleeve 9*a*, and the magnetic force lines between the magnetic pole S2 and the magnetic pole N4 are generated to thereby cause the bridge phenomenon of the developer.

Next, in order to increase the magnetic force Fr between the poles and reliably hold the developer in the developing sleeve 8*a*, the strength of the magnetic field of the magnetic pole N3 is increased. As a result, the component obtained in the direction of the center of the developing sleeve 8*a* of the magnetic force Fr is reliably reversed (i.e., becomes negative) at the point where the peak value of the magnetic force of the magnetic pole N3 is 80% as described above, thereby making it possible to smoothly deliver the toner.

However, the magnetic pole N3 attracts the developer provided in the developing chamber 3 and the agitating chamber 4 to thereby increase a coat thickness of the developer in the developing sleeve 9*a*. As a result, the electrostatic latent image formed as a toner image in the first developing process is scraped off in the second developing process (i.e., scavenging phenomenon). It means that, the phenomenon is closely related to the strength and position of the magnetic field of the magnetic pole N3, so it is preferable that the magnetic pole N3 be arranged at the upstream side of the rotating direction of the developing sleeve 8*a* with respect to the closest position between the developing sleeve 8*a* and the developing sleeve 9*a*.

Figure 6:
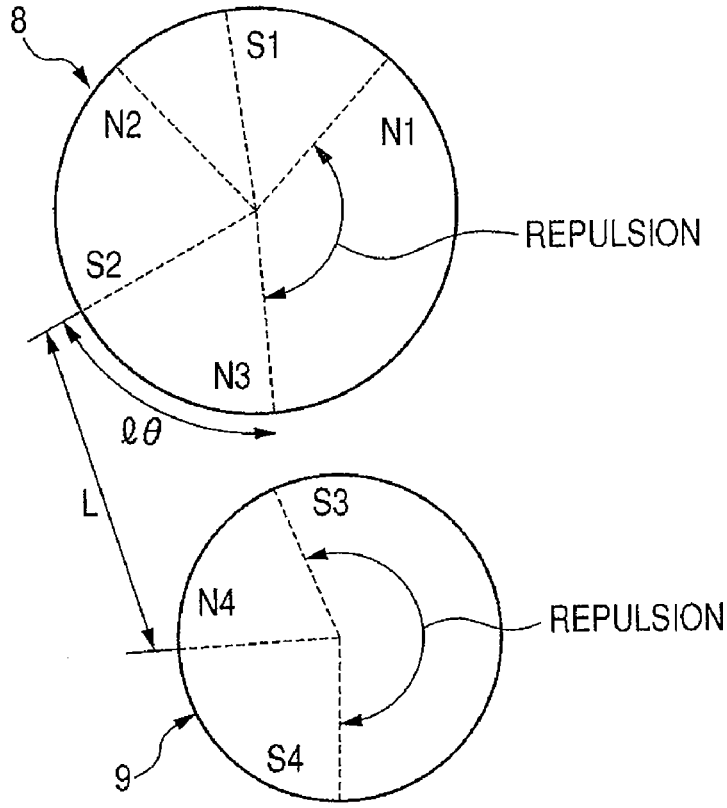
FIG. 6 is an explanatory diagram for explaining a strength of a magnetic field of a magnetic pole N3 and a positional relationship in the developing apparatus according to the present invention.
Figure 7:
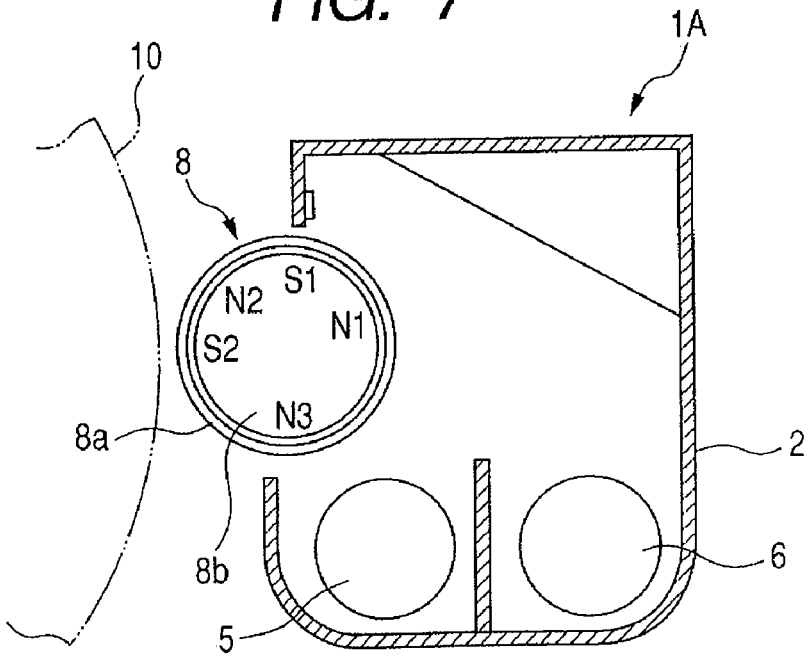
FIG. 7 is a cross-sectional view of a conventional developing apparatus.
Figure 8:
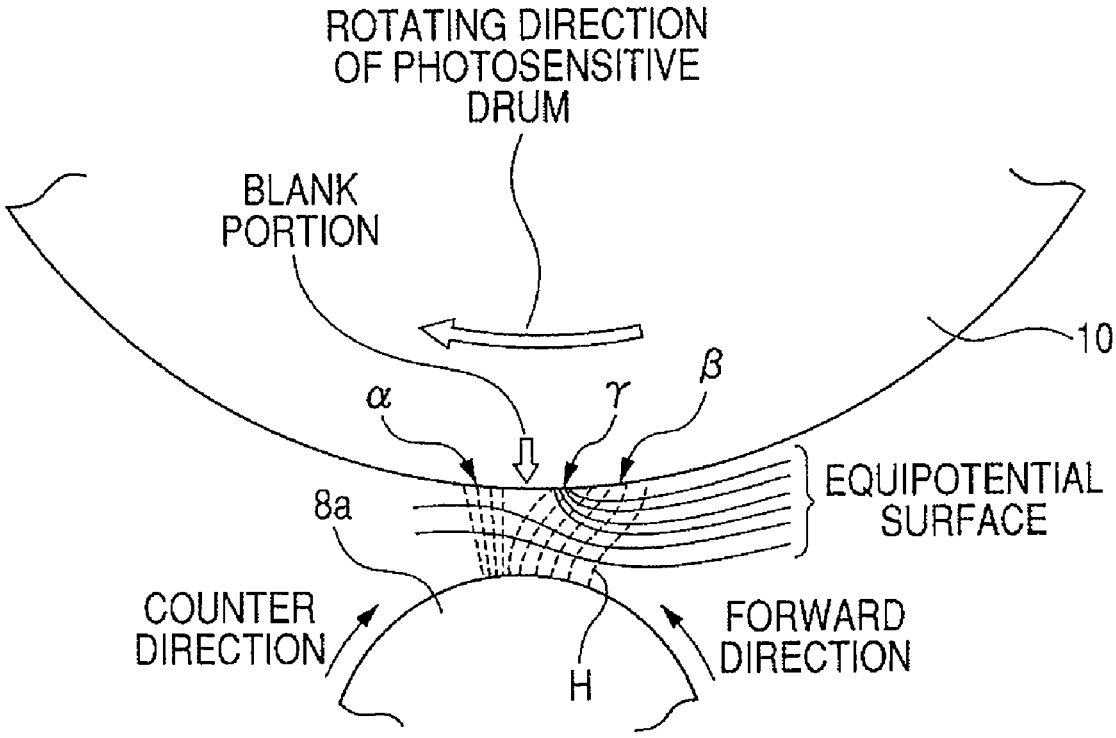
FIG. 8 is an explanatory diagram of a principle of generation of a blank portion.
Figure 9:
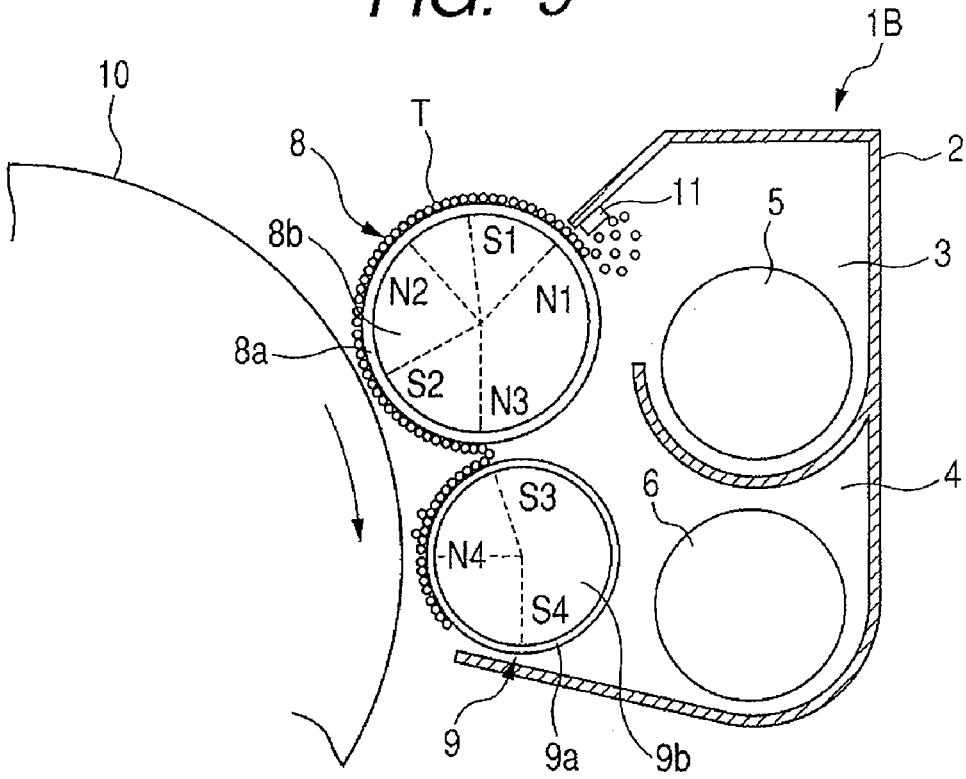
FIG. 9 is a cross-sectional view showing the conventional developing apparatus.
Figure 10:
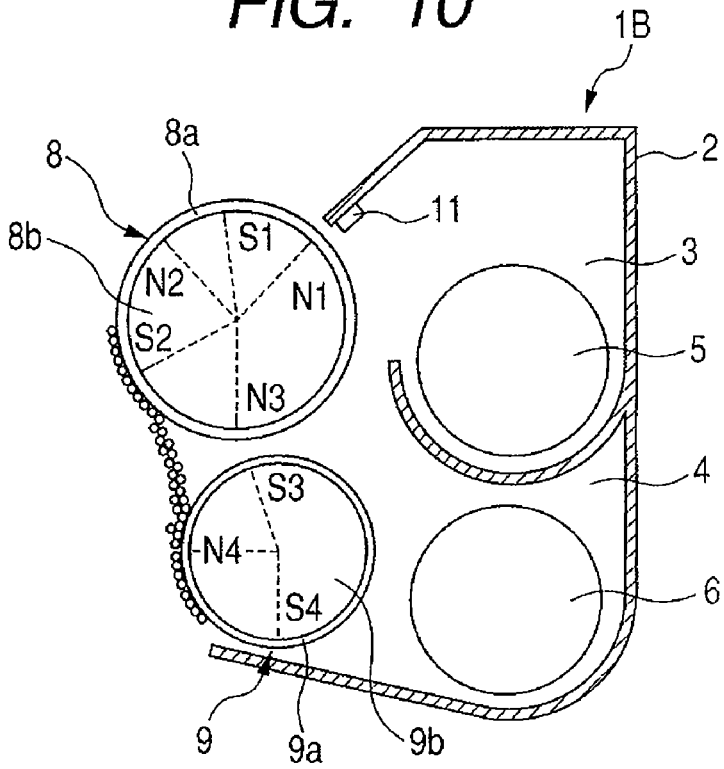
FIG. 10 is a cross-sectional view for explaining a bridge phenomenon of a developer in the conventional developing apparatus.

Next, with reference to FIG. 6, the relationship between the strength and the position of the magnetic pole N3 according to this embodiment will be described.

A magnetic moment obtained when the magnetic dipole approximation at the magnetic pole N3 is performed is set as M1, and a magnetic moment obtained when the magnetic dipole approximation at the magnetic pole N4 is performed is set as M2. An angle formed between an arbitrary position (e.g., a position of the magnetic pole S2 shown in FIG. 6) of the developing sleeve and the magnetic pole N3 is set as θ, a radius of the developing sleeve 8*a* is set as l, and a linear distance from the arbitrary position to the magnetic pole N4 is set as L. In this case, at an arbitrary position, a strength of the magnetic field generated by the magnetic pole N3 is set as B1, and a strength of the magnetic field generated by the magnetic pole N4 is set as B2, thereby making it possible to approximate these strengths as in the following formulae:

$$B1 \propto (1/4\pi u)*(M1/(l\theta)^2), \text{ and}$$

$$B2 \propto (1/4\pi u)*(M2/L^2).$$

When the strength B1 of the magnetic field at the magnetic pole N3 is larger than the strength B2 of the magnetic field at the magnetic pole N4, that is, when a formula $$B1/B2=(M1/M2)*(L/l\theta)^2>1$$

is satisfied, the magnetic force lines between the magnetic pole S2 and the magnetic pole N3 are thickened, so the developer is more reliably carried to the magnetic pole N3. More preferably, the strength B2 of the magnetic field at the magnetic pole N4 is in the range of 600 gauss to 1500 gauss.

When the image formation is performed by using the developing apparatus with the above-mentioned structure, a high-quality image is obtained without occurring deterioration due to the retention of the developer and without causing the bridge phenomenon of the developer.

In the embodiments, described is the developing apparatus which performs the developing process by using the two-component developer containing the non-magnetic toner and the magnetic carrier as the magnetic developer.

However, it is also possible to adapt the present invention to a developing apparatus which performs the developing process by using the one-component developer containing the magnetic toner serving as the magnetic developer.

It should be noted that, generally in the developing apparatus using the two-component developer, the carrier becomes imbalanced in terms of electric charges due to scattering of toner onto a photosensitive drum, and as a result, the carrier constituting a magnetic brush in the second developing process contains counter charges. Therefore, there arises a problem in that the scavenging phenomenon is caused when the carrier is brought into contact with the photosensitive drum, thereby electrostatically pealing off the toner from the toner image to cause the scavenging phenomenon. In the case where the present invention is adapted to the developing apparatus using the two-component developer, it is possible to solve such the problem inherent to the developing apparatus using the two-component developer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-259967, filed Sep. 7, 2005, which is hereby incorporated by reference herein in its entirety.

What is claimed is:

1. A developing apparatus for developing an electrostatic image formed on an image bearing member, comprising:

a developer container, which contains a magnetic developer;

a first developer carrying member rotatably provided to the developer container, for carrying the magnetic developer to feed the magnetic developer to a first developing portion;

a second developer carrying member rotatably provided to the developer container in the same direction as the first developer carrying member, for carrying the magnetic developer delivered from the first developer carrying member to feed the magnetic developer to a second developing portion;

first magnetic field generating means arranged to be fixed in the first developer carrying member, wherein the first magnetic field generating means includes a first magnetic pole arranged to be closest to the second developer carrying member, and a second magnetic pole arranged to be adjacent to an upstream side of a movement direction of the first developer carrying member with respect to the first magnetic pole, and having a polarity opposite to the first magnetic pole; and second magnetic field generating means arranged to be fixed in the second developer carrying member, wherein the second magnetic field generating means includes a third magnetic pole which is closest to the first developing carrying member, and has a polarity opposite to the first magnetic pole, wherein a peak position, where a strength of a magnetic field of the first magnetic pole becomes a peak with respect to a circumferential surface of the first developer carrying member, is provided upstream, in the movement direction of the first developer carrying member, of a closest position between the first developer carrying member and the second developer carrying member, and wherein, the developing apparatus is configured such that a magnetic force, which is designated as Fr, is obtained by combining a magnetic force of the first magnetic field generating means and a magnetic force of the second magnetic field generating means in the vicinity of the first developer carrying member, and a direction toward a center of the first developer carrying member is designated as positive, (a) a component of the force Fr obtained in the direction of the center of the first developer carrying member is positive at least from the second magnetic pole, in the movement direction of the first developer carrying member, to the peak position, and (b) the component of the force Fr obtained in the direction of the center of the first developer carrying member changes to be negative in the area from the peak position, in the movement direction of the first developer carrying member, to the closest position between the first developer carrying member and the second developer carrying member.

2. A developing apparatus according to claim 1, wherein the magnetic developer contains non-magnetic toner and a magnetic carrier in a mixed manner.

3. A developing apparatus according to claim 1, wherein the vicinity of the first developer carrying member is a distance from a surface of the first developer carrying member to a bristle tip of a magnetic brush made by the magnetic developer.

4. A developing apparatus according to claim 1, wherein the second magnetic field generating means further includes a fourth magnetic pole, which is adjacent to a downstream side of the third magnetic pole in a movement direction of the second developer carrying member and arranged in the vicinity of the portion opposing to the image bearing member, and the fourth magnetic pole having a polarity opposite to the second magnetic pole.

5. A developing apparatus according to claim 4, wherein a strength of a magnetic field of the fourth magnetic pole is 600 gauss or more and 1500 gauss or less.

* * * * *